US007931575B2

(12) United States Patent
Rochford

(10) Patent No.: US 7,931,575 B2
(45) Date of Patent: Apr. 26, 2011

(54) APPARATUS FOR PERFORMING BODY EXERCISES

(76) Inventor: Timothy Shawn Rochford, Yorkville, IL (US)

( * ) Notice: Subject to any disclaimer, the term of this patent is extended or adjusted under 35 U.S.C. 154(b) by 0 days.

(21) Appl. No.: 12/541,929

(22) Filed: Aug. 15, 2009

(65) Prior Publication Data

US 2010/0041531 A1 Feb. 18, 2010

Related U.S. Application Data

(60) Provisional application No. 61/089,530, filed on Aug. 16, 2008.

(51) Int. Cl.
*A63B 71/00* (2006.01)

(52) U.S. Cl. ..... 482/148

(58) Field of Classification Search ..... 482/62, 482/140, 142, 51, 92, 148, 907–908, 121–130, 482/34, 38, 41, 93–96
See application file for complete search history.

(56) References Cited

U.S. PATENT DOCUMENTS

| | | | | |
|---|---|---|---|---|
| 3,345,067 | A * | 10/1967 | Smith | 482/123 |
| 4,241,914 | A * | 12/1980 | Bushnell | 482/130 |
| 5,013,035 | A * | 5/1991 | Nathaniel | 482/129 |
| 6,267,711 | B1 * | 7/2001 | Hinds | 482/121 |
| 6,612,845 | B1 * | 9/2003 | Macri et al. | 434/247 |
| 7,137,937 | B2 * | 11/2006 | Croft | 482/142 |
| 7,229,392 | B2 * | 6/2007 | Turnbull et al. | 482/129 |
| 2009/0054215 | A1 * | 2/2009 | Mcbride et al. | 482/129 |
| 2009/0069161 | A1 * | 3/2009 | Caldwell | 482/138 |
| 2009/0215594 | A1 * | 8/2009 | Panaiotov | 482/130 |

OTHER PUBLICATIONS

Advertisement for "Thera-Band Wall Station" product on Source 1 Medical website: http://www.source1medical.com/21910-Wall-Station?sc=2&category=7410.
Advertisement for "Web Slide Delux Assortment-Stainless Steel" product on Source 1 Medical website: http://www.source1medical.com/s.nl/it.A/id.15600/.f?sc=2&category=7410.
Advertisement for "Professional Exercise Station" product on Source 1 Medical website: http://www.source1medical.com/21900-Professional-Exersice-Station?sc=2&category=7410.
Advertisement for "Clinical Wall Pulley Systems" product on Tartan Group Direct website: http://www.tartangroup.com/store/item.asp?ITEM_ID=3241&DEPARTMENT_ID=49.
Advertisement for "Resistance Chair Exercise System" product on Isokinetics website: http://www.isokineticsinc.com/category/chair/product/cf_cfc100.
Advertisement for "Exertools Body Dome" product on Isokinetics website: http://www.isokineticsinc.com/category/chair/product/et_bdome.
Advertisements for Wheel Chair Accessible Workout Machines on Professional Fitness Concepts website: http://www.pfcfitnessequipment.com/search.aspx?manuid=&fld_muscle_groupid=.

(Continued)

*Primary Examiner* — Lori Baker
(74) *Attorney, Agent, or Firm* — Flachsbart & Greenspoon, LLC; Steven M. Evans

(57) ABSTRACT

A method of using a self-contained portable exercise apparatus for performing upper and/or lower body exercises. The method includes performing a body exercise without weights using an elastic cord, a stability ball, and/or a stretch cord with an apparatus having a ground-engaging base plate which rigidly supports first and second vertical members, where each vertical member has aligned clearance openings. Holding members are attached to the base plate for removably holding stretch cords and a support bar is removably received by two aligned clearance openings in the first and second vertical members.

2 Claims, 3 Drawing Sheets

OTHER PUBLICATIONS

Advertisement for "Monkeyboard" product on Perform Better website: http://www.performbetter.com/detail.aspx__Q__ID__E__5103__A__CategoryID__E__330.
Advertisement for "Adjustable Double-Rail Wall Mount Gym" product on Perform Better website: http://www.performbetter.com/detail.aspx__Q__ID__E__5012__A__CategoryID__E__330.
Advertisement for "Lebert Equalizer" product on Power-Systems website: http://www.power-systems.com/p-3109-lebert-equalizer.aspx.
Advertisement for "Adjustable Wall Mount Gym" product on Perform Better website: http://www.performbetter.com/detail.aspx__Q__ID__E__3812__A__CategoryID__E__330.
Advertisement for "Reebok Deck" product on Perform Better website: http://www.performbetter.com/detail.aspx__Q__ID__E__4713__A__CategoryID__E__330.
Advertisement for "Lifeline Wall Gym 4000" product on Isokinetics website: http://www.isokineticsinc.com/category/chair/product/II__6-wg4000.
Advertisement for "Lifeline Wall Gym 2000" product on Isokinetics website: http://www.isokineticsinc.com/mm5/merchant.mvc?Screen=PROD&Store__Code=isokinetics&Product__Code=II__6.
Advertisement for "Lifeline Four in One Chin-up Bar" product on Isokinetics website: http://www.isokineticsinc.com/mm5/merchant.mvc?Screen=PROD&Store__Code=isokinetics&Product__.
Advertisement for "Lifeline Wheel Gyms" product on lsokinetics website: http://www.isokineticsinc.com/mm5/merchant.mvc?Screen=PROD&Store__Code=isokinetics&Product__Code=II__wheel.
Advertisement for "Lifeline Work Station" on Isokinetics website: http://www.isokineticsinc.com/mm5/merchant.mvc?Screen=PROD&Store__Code=isokinetics&Product__Code=II__6-ws&Categ.
Advertisement for "24x40 Elastic Base Vertical Leap Platform" on JUMPUSA website: http://www.jumpusa.com/pc/VERTMASTER/VERTICALJUMP/Vertical+ Masters+-+24+X+40+Elastic+Base+Ver.
Advertisement for "Wall Gym 2000 Cable Resistance Station" on JUMPUSA website: http://www.jumpusa.com/mm5/merchant.mvc?Screen=PROD&Store__Cod...WALLGYM2000&cvsfa=1182&cvsfe=2&cvs.
Advertisement for "Wall Gym 4000 Cable Resistance Station" on JUMPUSA website: http://www.jumpusa.com/mm5/merchantmvc?Screen=Prod&Store__Code=J&Product__Code=WALLGYM4000.
Advertisement of "Keiser Infinity Six Pack w/ Power Displays" product on Power-Systems website: http://www.power-systems.com/p-3878-keiser-infinity-six-pack-w-power-displays.a.
Advertisement of "Keiser Infinity Functional Trainer w/ Power Display" product on Power-Systems website: http://www.power-systems.com/p-3874-keiser-infinity-functional-trainer.
Advertisement of "Keiser Infinity Performance Trainer w/ Power Display" product on Power-Systems website: http://www.power-systems.com/p-3882-keiser-infinity-performance-train.
Advertisement for "Triplex Pulley Weights" product on MSEC website: http://www.medical-supplies-equipment-company.com/product/ppf/id/13710/new__prod__full.asp.
Advertisements for Dip Pull Up Stations products on Nextag website: http://www.nextag.com/dip-pull-up-station/shop-html.
Advertisement for "Chin-Up or Pull Up Bar" product on Power-Systems website: http://www.power-systems.com/p-3320-chin-up-or-pull-up-bar.aspx.

* cited by examiner

APPARATUS FOR PERFORMING BODY EXERCISES

REFERENCE TO RELATED APPLICATIONS

This patent application claims the benefit of U.S. Provisional Application No. 61/089,530 filed on Aug. 16, 2008, the disclosure of which is incorporated herein in its entirety by reference.

BACKGROUND OF THE INVENTION

1. Field of the Invention

This invention relates to an apparatus for physical exercise and more particularly to a self-contained, exercise device for use by an individual for performing a variety of exercises to strengthen and condition muscles.

2. Description of Related Art

Individuals of all ages are interested in staying fit and being in condition. One method of doing so is by jogging or walking outside or, when at home, by doing sit ups, push ups and stretching exercises. It is well recognized, however, that these simple exercises affect only a limited number of muscles in a person's body.

At the present time there are many devices available for use by an individual to exercise various muscles in his/her body. They are, however, usually designed for a specific exercise which affects only a single group of muscles. They are not designed to help an individual exercise multiple groups of muscles in his/her body by performing a plurality of different exercises.

What is needed is an apparatus that is simple in design, economical to build and can be used to exercise various muscles and groups of muscles in the human body.

SUMMARY OF THE INVENTION

In an exemplary embodiment of the present invention, there is disclosed a method of using a self-contained portable exercise apparatus for performing upper and/or lower body exercises. The method includes performing a body exercise without weights using an elastic cord, a stability ball, and/or a stretch cord with an apparatus having a ground-engaging base plate which rigidly supports first and second vertical members, where each vertical member has aligned clearance openings. Holding members are attached to the base plate for removably holding stretch cords and a support bar is removably received by two aligned clearance openings in the first and second vertical members.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

The apparatus disclosed is a mobile exercise equipment that has multiple purposes and uses. It provides a means for a user to perform body exercises like push ups, pull ups, dips, etc. It also allows anchoring stretch cords (used for resistance training) to multiple locations on the apparatus making the resistance training more effective than if the exercise were simply being performed against gravity or with a single stretch cord anchored at a single point or location. A cross bar also acts as a tool for stretching muscles after a workout by grabbing onto it with the hands or by placing one leg up on the cross bar.

The cross bar and towers function as a stabilizing or balance point for an exerciser (a user can place one hand on the bar or tower while lifting one leg from the floor for either a stretching exercise or an exercise-specific movement.

Figure 1:
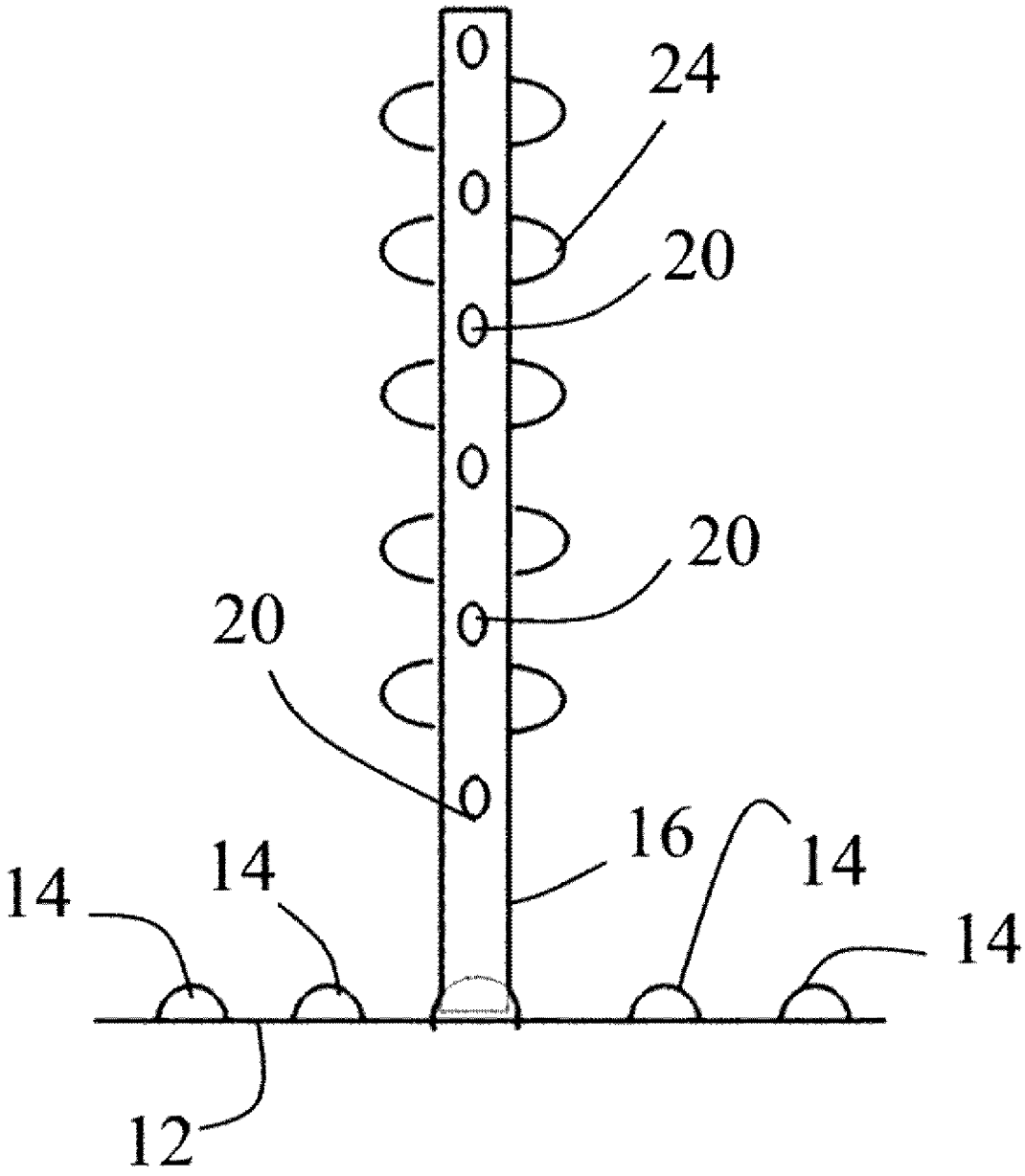
FIG. 1 is a side view of an apparatus that can be used when doing various exercises that provide resistance to various groups of muscles in accordance with the principles of the invention.
Figure 2:
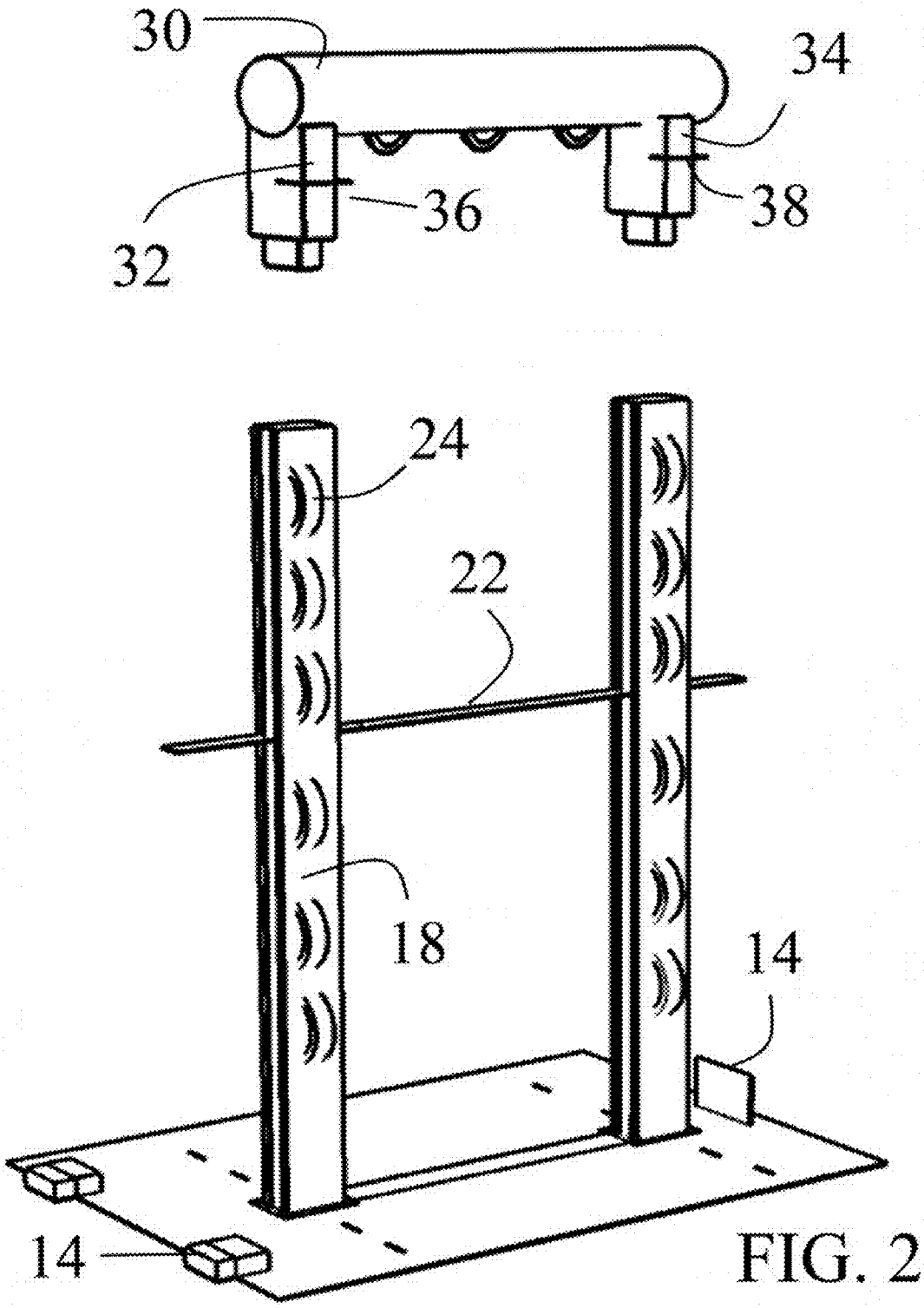
FIG. 2 is a front view of the apparatus of FIG. 1.
Figure 3:
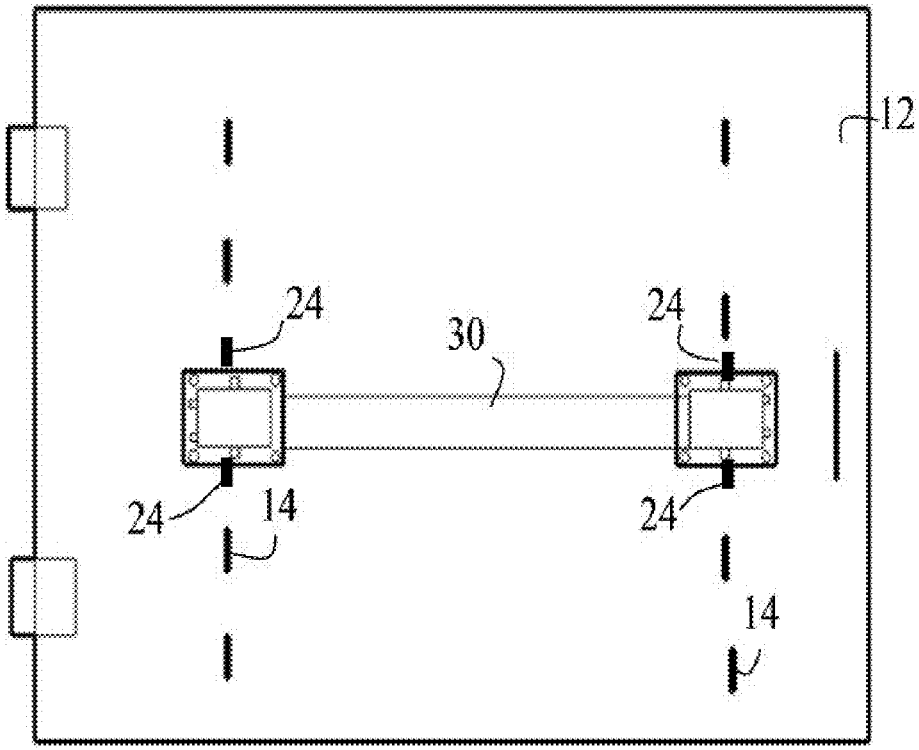
FIG. 3 is a top view of the apparatus is accordance with the principles of the invention.

Referring to FIGS. 1-3, the apparatus consists of stable, flat rectangular-type base 12 that has several arch-shaped rods 14 (which are used as anchor sites for stretch cords) attached to it.

Two "towers" 16, 18 are rigidly attached to the base 12. The towers are spaced apart on the base so that enough room is provided for an individual to execute certain exercises while being positioned directly between the towers. Each tower has holes 20 that are aligned with holes in the opposite tower through which a round straight cross bar 22 can be inserted to create a level "bridge" from one tower to the other. This is the cross bar on which a person can hold onto to perform push ups, pull ups, dips, stretching, balancing or any other body weight-type exercise. Multiple arch-shaped rods 24 are attached to the towers. The locations of the rods are the same on each tower. These arch shaped rods also provide anchor points for stretch cords.

Located across the top of the two towers is a support bar 30 that is attached to vertical members 32, 34 which slide into the top of the towers. Collars 36, 38 that are welded to the vertical members provide a stop which defines the depth that the members slide into the towers. The support bar provides stability to the two towers when the stretch cords are being used in various exercises.

The features of the apparatus are as follows:

The apparatus has 2 wheels and a handle which allows it to be pick up at one end and rolled to a desired location. It can easily accommodate 4 users simultaneously. Depending on the exercises being performed, as many as 8 people can use the apparatus at the same time. The apparatus can be in conjunction with other pieces of exercise equipment, such as Bosu Trainers, Steps, Stability Balls, Dumbbells, Body Bars, Foam Rollers, Medicine Balls, Weighted Vests, Balance Boards, etc.

The apparatus can be used for Functional training, Sport-specific training, and Traditional exercise/fitness training.

A user has the capability of performing multiple exercises at the same time, for example—while seated on a chair, can be performing a chest press (one arm or two arms while also executing a knee extension or leg press exercise. Quick Clips provide quick and easy changeover of spring cords for changing exercises.

Quick Clips also provide quick and easy changeover of accessories (handles, ankle cuffs, etc., and any attachment with a ring could be used with these elastic tubes). Three different resistance levels (stretch cords) and four different lengths of stretch cords (6", 12", 18" and 24") Resistance level for any exercise can be easily increased by adding more stretch cords to the same anchor point(s).

Other stretch cords or bands can be used with the apparatus using hardware that can be purchased at a local hardware store.

Each Anchor loop is large enough to accommodate multiple Quick Clips, providing the ability to easily increase resistance by adding more stretch cords. The Tower Stabilizer Bar is round and has 3 High loops located on the bottom side of the round bar. In another embodiment there are 20 more or less mid-range loops –10 more or less on each Tower, 8 more or less Low loops on the base (4 more or less Loops on each end of the Base).

The Height of the Cross Bar is adjustable, having 5 more or less settings—spaced at predetermined distances from the Base which are used for body weight exercises (push ups, pull ups, dips, etc) according to Progressive Overload Principles. The apparatus can be used for flexibility training. It can be used as another anchor point for stretch cords or as a "barbell" (attach stretch cords or handles around each end) for exercises like Squats, Barbell Curls, Bent Over Row, etc.

The Tower Stabilizer Bar is removable and has 3 High Anchor loops for stretch cords. The Tower Stabilizer Bar maintains Tower stability (eliminates Base flexing and Tower movement) during certain exercises.

In an embodiment, The Tower Stabilizer Bar has a round Tower Stabilizer Bar which provides a higher point from which to perform Pull Up exercises The Towers are spaced far enough apart to allow a use of other equipment with the apparatus, including but not limited to Bosu Trainers, Stability Balls, weight benches, chairs, Step platforms, etc.

The towers are spaced far enough apart to accommodate most wheel chairs for disabled exercisers.

The Base Stabilizer Legs provide total unit stability (practically eliminates unit tipping due to pulling with elastic resistance) and are easy to install and remove for moving and storage of unit.

The apparatus has the following benefits:

- Can be used by children or adults
- Requires small area (in use and for storage)
- Base foot print is 2'×4' (not including Base Stabilizer Legs)
- Mobile—moves on 2 wheels
- Provides numerous and easily accessible anchor points for elastic tubing
- Multi-Angle Resistance—attach different elastic tubes to different anchor points, all located in the same plane as the exercise movement, for exercise movements that arc (Crunch, Bicep curl, Leg curl, Front Raise, Lateral Raise, etc).
- Provides additional resistance through a greater range of the arcing movement—challenging the strength curve for joint movements
- Multi-Planar Resistance—attach different elastic tubes to different anchor points either in the same plane as the movement or in a different plane from the exercise movement pattern, for pressing or pulling (straight-line) exercise movements (Chest Press, Leg Press, Rowing, etc)
- Challenges agonist and stabilizer muscle groups
- Safe and effective Progressive Overload (increases in intensity levels can be incremental, consistent and measured) can be achieved for body weight exercises for any user.

The stretch cord can be made of a natural material such as rubber or it can be of a plastic. The stretch cord can have a handle for grasping, or a band or strap at one end for positioning around a user's arm, wrist, ankle, foot etc. The cords are removably attached the base plate or to other parts of the apparatus and are used as an aid in doing a variety of exercises. The stretch cords can vary in length. A handle at one end is provided for ease of use. It can be of any conventional shape such as horseshoe shape or triangular shape.

The exercise apparatus disclosed, in combination with the stretch cord, stability ball and/or elastic cord is for aiding an individual in performing a number of exercises to strengthen and condition different muscles and groups of muscles in his/her body.

The apparatus disclosed is a stable, compact apparatus which provides for the performance of numerous upper and lower body exercises without the utilization of weights as disclosed below in more detail.

The apparatus here disclosed is used with each or the various exercises more fully identified below by name with instructions for performing the named exercise being given below each name.

Ankle Doral Flexion

Description:

This exercise strengthens the muscles that pull the foot (toes) up toward the front of the lower leg (or the knee). To strengthen the muscles through the full joint range of motion, start the exercise with the toes pointed down or away from the front of the lower leg or knee. This is an often neglected exercise, but an important one. Strengthening the muscles on the front of the lower leg (especially the anterior tibialis) can help prevent shin splints.

Instructions:

To perform one repetition of this exercise, do the following:

- Attach one end of an stretch cord to an anchor point on the Apparatus and the other end to an Ankle strap (or some attachment that can be secured safely to the foot). Be sure the anchor point provides resistance in direct opposition to the movement of the exercise.
- Place the Ankle strap around the foot, just above the toes. You do not want the Ankle strap to pull on the toes, but the strap should be as close to the first toe joint without actually being on (and putting pressure against) the toes.
- Position the foot so that:
  - The toes are pointed away or down (ankle is plantar flexed), and
  - The stretch cord is already pulled tight—there should be no slack in the cord at all. The more tension in the cord at the beginning of the exercise, the greater the resistance there is to the movement.
- The only movement in the exercise is at the ankle joint:
  - Pull the top of the foot up towards the front of the lower leg or knee until the joint cannot move any more.
  - Slowly let the foot move back to the starting position (toes pointing down or away from the knee)

Leg Curl—Standing

Description:

A Leg Curl (also known as Hamstring Curl or Knee Flexion) can be performed in a variety of ways.

- The exercise could be performed standing on a Step platform, or anything that elevates the base leg above the floor. This would eliminate the need to laterally tilt the pelvis to perform the exercise (so the leg being exercised is able to easily move from the start position).

Instructions:

Attach a stretch cord to the Apparatus and to the ankle cuff.

The exerciser should be positioned so there is resistance from the stretch cord as soon as the knee begins to vend (flex).

Stand upright keeping the spine, neck and pelvis in a neutral position. The only movement should be in the knee joint—slowly, with control, bend the knee and bring the heel upwards, until the joint stops the movement.

Slowly lower the leg (straightening the knee) back to the starting position of the exercise.

Knee Extension (Leg Extension)

Description:

Knee, or commonly known as Leg Extension exercises can be performed as follows.

Instructions

Choose a length of stretch cord that will allow you to be positioned where you prefer.

Attach one of the stretch cord to an ankle cuff and the other end to the Apparatus.

Put the ankle cuff on the leg to be worked.

Position the stability ball (or whatever you plan to sit on) in a position where the stretch cord is taut (no slack) when you are in the sitting position.

Sit up straight (spine neutral) and engage you core to maintain stability and balance.

Slowly and controlled, straighten (extend) the knee.

Slowly allow the lower leg to return to eh starting position.

Hip Joint Abduction Exercises

Description:

To get the most benefit from this exercise, it should be performed with the hips in a neutral position (straight, not flexed). The exercise may be performed while standing or lying down (on your side or on your back).

Instructions—Standing Hip Abduction:

After attaching an stretch cord (or cords) to an Ankle cuff and the Apparatus unit, position yourself so that the cords (all) are under tension. There should be no slack in (any of) the cord(s).

Balance yourself by holding the apparatus unit with one or both hands or use no hands to add stabilization work to the exercise.

Hip Joint Flexion Exercises

Description:

The Apparatus provides a way to perform Hip joint flexion.

Instructions—Standing Hip Flexion:

After attaching a stretch cord (or cords) to an Ankle cuff and the Apparatus, position yourself so that the leg with the ankle cuff is either in alignment with the base leg or pulled back into a hyper-extended position (do NOT tilt the pelvis when hyper-extending the hip).

The stretch cords (all) should be under tension in this starting position. There should be no slack on (any of) the cords(s).

Balance yourself by holding the Apparatus unit with one or both hands or use no hands to add stabilization work to the exercise.

Hip Rotation—Internal & External

Description:

Both Internal and External exercises can be performed on the Apparatus.

Instructions—External Rotation:

You can begin the exercise with the feet parallel to each other or with the exercising hip/leg infernally rotated (greater range of motion for the exercise).

Keep the bottom of the foot as flat (level) to the ground as possible) without touching the ground or restricting the exercise movement).

Without moving the pelvis, slowly rotate outward at the hip. This moves the foot/toes/knee to a position where they are pointed out (laterally), towards the side of the body.

Instructions—Internal Rotation:

You should begin the exercise with the exercising leg/hip externally rotated.

Keep the bottom of the foot as flat (level) to the ground as possible (without touching the ground or restricting the exercise movement).

Without moving the pelvis, slowly rotate inward at the hip. This moves the foot/toes/knee to a position where they are pointed forward or slightly inward (medially).

Squat—Hip Joint Exercises

Instructions:

Attach one end of the stretch cord to the Apparatus base and the other end to an attachment, which can be secured to a bar.

Secure the handles over the support bar enough to ensure they will not slip off the bar during the exercise.

Position the bar across the upper back with the hands gripping the bar in a comfortable position. May want to use both hands to hold on to the handles to prevent slipping off the bar.

Position yourself with both feet pointed straight ahead (or slightly pointing outward).

Look straight ahead and maintain this neck/head position through the full exercise movement.

Stand erect. The stretch cord should be taut.

Slowly descend (flex hips and knees) in the Squat, keep the shoulders between the hips and the knees. Make sure the knees track out overt (in the same direction as) the toes.

Important—the stretch cord should still be tight (no slack) at the bottom of the movement.

Slowly (unless doing a power exercise) extend the hips and knees and return to the standing (starting) position.

Good Morning (Hip Extension) Exercise

Instructions:

Keep the spine locked into a neutral position, maintaining the natural curves of the spinal column.

The feet should be parallel with each other.

Knees slightly flexed (bent).

Look straight ahead (maintaining the neck in a neutral position).

Position the Cross Bar below the back of the neck, on top of the upper Trapezius muscles. The Bar can be padded to prevent discomfort.

To increase the intensity (resistance) of the exercise, you can do any (or all) of the following:

Use a weighted bar (with the stretch cord attached at each end) across the shoulders Add more stretch cord to the same anchor points.

Add more stretch cord to different anchor points on the Apparatus unit.

Wear a weighted vest while performing the exercise.

Spinal Flexion—Abdominal Crunch

Instructions:

Attach a stretch cord to the same level of an Apparatus tower (one for each hand).

Position the stability ball (or whatever you are lying on) directly between the two towers and far enough away form Apparatus that the elastic bands are taut at the start position of the exercise. There should be no slack in the tubing.

Start position—hold the handles somewhere between the shoulders and the ears so that when you do the crunch, the tubing does not come in contact with your body (along your Traps).

Start position—make sure the lower back is supported on the stability ball, the knees are bent 90 degrees or more and both feet are flat on the floor.

Execution—curl up your spine (try bringing your chin to your chest. Do NOT flex or bend at the hips. Hold the movement for a second (or more).

Slowly, let your spine extend back into the starting position.

Lateral Flexion (Side Bend)

Instructions:

Attach a stretch cord to the Apparatus and a handle.

Hold the handle in one hand and get into a position where the stretch cord anchor point is directly to the side (your arm hangs straight down while holding the handle and the cord is vertical to the ground).

The stretch cord must be taut.

Start with and maintain a neutral spine and neck throughout the movement pattern.

Slowly bend to the side, maintaining alignment between the hips and shoulders. Concentrate on "squeezing" the muscles on the side of the body opposite from the side holding the cord as the shoulder is pulled down.

Slowly let the shoulder rise up, back to the start position of the exercise.

Spinal Extension

Instructions:

The spinal Extension exercise can be performed on the Apparatus unit by:

Attaching a stretch cord from one anchor point on one end of the unit base (or tower) to another anchor point on the other end of the unit base (or tower).

Position the stretch cord across the upper back of the individual. The higher the cord is on the back (closer to the shoulders), the greater the resistance to the movement.

If necessary, use a partner (or some other method) to anchor your feet in place for the exercise. This allows you to completely concentrate on the extension movement of the spine.

In the down position you want to round your spine around the stability ball (so make sure the stability ball is small enough to do this)—spinal flexion.

Lift your head and shoulders as high as you can by arching your back.

Lateral Rotation—Seated

Instructions:

One stretch cord is attached to a position on the Apparatus towers which is approximately the same height as the individual's shoulders so there is a direct line of pull by the stretch cord against the movement position. The other end of the stretch cord is secured to opposite ends of a bar, which is positioned on the upper back of the exerciser.

The Exerciser must be positioned so that when he/she is facing straight forward (away from Apparatus or towards Apparatus) both stretch cords are under slight tension before the exercise begins.

More stretch cords can be added to the exercise to increase the intensity—to the same anchor points or to different anchor points.

Make sure the spine and neck (and hips, if kneeling) are in a neutral position.

Slowly turn the upper body without moving the hips at all. As you turn one way, there will be slack in one side of the stretch cords, but the other side should be pulled even tighter (resisting the rotation movement).

Once you reach the end of the rotation on one side, change direction and slowly rotate in the opposite direction.

Plank—Prone

Instructions:

The Prone Plank is performed by:

Attach one end of a stretch cord to an anchor point on the base of the Apparatus. Then pull the other end of the stretch cord across the back side of your body to the opposite side of the Apparatus base and attach it to an anchor point on that side. For the most benefit, make sure the cord is positioned so it will be across your center of gravity (about belly button level).

Begin by lying flat on the floor, face down with your forearms and elbows flat on the ground. Lock your knees into a straight joint position.

Engage the Cone muscle groups to lift the hips off the floor until your body is aligned from shoulders to heels. The only parts of your body touching the floor are the forearms/elbows/hands and the toes/ball of the feet.

Hold this position for a set length of time.

Shoulder Lateral Raise (Shoulder Abduction)

Instructions:

The exercise is performed according to the following:

Be positioned so that the tubing will not come into contact with your body as you pull your arm up.

Slightly bend the knees and hips, but maintain the spine and neck is a neutral position.

Make sure the stretch cord is under slight tension when the arm is in the start (low) position. If the stretch cord is loose, move further away from the unit or use a shorter cord.

Lock the elbows into a fixed joint position. This is maintained through the complete movement.

Pull the hand/arm up, away from the side of the body. This can be in line with the upper body or slightly anterior to the upper body.

Slowly lower the arm back to the starting position of the exercise.

Plank—Side

Instructions:

Attach a stretch cord to an anchor point on one side of the Apparatus and then position the cord across the mid-line of your body and attach the other end to an anchor point located on the other side of the Apparatus.

The Side Plank is performed by:

Begin by lying on your side, on the floor. Your forearm and elbow of the lower side of your body are flat on the ground. Your other hand is placed on the floor in front, to offer better balance. You are in full contact with the floor from the hips down to the side edge of the foot on the lower side of your body. Lock your knees into a straight or slightly bent joint position.

Engage tine Core muscle groups to lift the hips off the floor until your body is aligned from shoulders to heels. The only parts of your body touching the floor and the forearms/elbows/hands and the side edge of the bottom foot.

Hold this position for a set length of time.

Chest Press

Instructions:

Make sure the stretch cord is taut at the start position of the exercise movement.

The exerciser should maintain a neutral spine and neck while performing the exercise movement.

Push the hands forward until just before the elbows are fully extended. Keep a slight bend in the elbows.

To do this exercise in a functional manner, let the shoulder blades protract as the arms extend.

Slowly and controlled, let the arms return to the start position.

Crossover (Chest Pull—Low)

Instructions:

Start the exercise with the arm abducted to shoulder level or slightly above.

If the arm should be slightly bent and remain locked in that position through the complete movement pattern.

The stretch cord should be taut in the start position.

Slowly, with control, pull the hand down (keep the elbow locked) to a position that is slightly in front of your body.

Slowly allow the hand/arm to raise up, returning to the start position.

Push Up

The Apparatus provides a way to perform the Push Up using the Progressive Overload Principle. The intensity (force required to perform) of the exercise can vary form very easy (using the Cross Bar at the highest setting—like doing a Wall Push Up) to very difficult (hands on the floor & the feet elevated above the floor with an stretch cord attached to the base of the Apparatus and strapped across the exerciser's back).

Progression Examples:

1. Cross Bar in top position of towers—no stretch cord.
2. Add a light stretch cord from lower to lower, across the exerciser's upper back. Make sure cord is positioned so it is in direct opposition (should be in alignment with the extended arms when executing the Push Up for maximum resistance to the movement) to the Push Up movement.
3. Change the stretch cord to the next highest resistance or add a second light stretch cord to the same anchor points on the Towers.
4. Continue to increase stretch cord resistance by either adding cords or going to the next highest resistance level cord or both.
5. Move Cross Bar to next lowest position—no stretch cord.
6. Repeat Steps 2 through 5 until the exerciser is eventually performing floor Push Ups (remove the Cross Bar). Start with no stretch cord across the exerciser's back.
7. Repeat Steps 2 through 4.

Shoulder Joint Horizontal Abduction

Instructions:

The exercise is performed according to the following:

You may either have the whole spine supported by the stability ball or have the stability ball directly under the upper back (shoulder blade area) in order to challenge the core while performing the exercise.

Position feet in order to be able to maintain balance through the full movement pattern. The closer the feet are together, the more your balance is challenged.

The start position of the exercise should be as follows:

The Arm is fully extended (or a slight bend in the elbow) to the side, and

The stretch cord is under slight tension at the standing position.

Lock the elbow joint in position. It should not change position (joint angle) during the exercise.

Pull the arm upward, across the body, keeping the hand in the same horizontal line during the full movement. Stop the movement when you reach the end of the range of motion of the shoulder joint (this is the point where the shoulder has to come off the ball to keep the arm moving across the body).

Slowly return the arm to the starting position to complete the repetition.

Overhead Press—Seated

Instructions:

The exercise could be performed starting with the elbows pointing forward (shoulder flexion) or with the elbows pointed to the side.

The exerciser should start with and maintain a neutral spine and neck throughout this exercise.

Make sure the stretch cord is taut while in the start position.

The start position could be with the hands at shoulder level (elbows close to the ribs) or with the elbows at about shoulder level.

Slowly extend the arms to a point just before the elbows are straight. Maintain the elbows directly below the hands through the complete movement pattern.

Slowly lower the hands/elbows to the start position.

Pull Up

The intensity (force required to perform) of the exercise can be varied through different foot placement and by strapping stretch cord across your body to resist the Pull Up movement.

Lying on your back, hips at same horizontal level as the shoulders (challenge core by maintaining alignment of spine during the exercise), or Sitting upright under the Cross Bar (hips are directly under the Cross Bar)

Rowing

Instructions:

After attaching the proper stretch cord to the Apparatus anchor points (one for each arm) and to two handles, perform the exercise according to the following description:

Position yourself so that you are centered between the two towers and with your arms outstretched (hand shoulder high, elbows pointed outward, thumbs positioned towards each other), the cord is taut.

The spine and neck should be maintained in a neutral position.

Feet flat on the floor and spaced enough to maintain balance on the stability ball.

The movement starts with the arms/elbows high—slowly pull the elbows straight back and squeeze the shoulder blades together/

At the end of the movement (elbows positioned past the posterior side of the body), the hands should be:

(from an overhead view) in a direct line between the elbow joints and the anchor point for the tubing on Apparatus. The hands should not move in towards the chest or shoulders, and (from a side view) the hands should be in line with the elbows and the anchor points on Apparatus. The hands should not be higher or lower than the line drawn between the elbows and the anchor points.

Slowly let the arms extend back to the starting position.

Cautions

Use slow, controlled movements.

Do not let the hands move in towards the chest as you pull the tubing.

Do not let the hands move upwards or downwards as you pull the tubing. Pull straight back.

Maintain spinal alignment (neutral) through the full motion of the exercise.

Shoulder Joint Extension

Instructions:

The exercise is performed according to the following:

Slightly bend the knees and hips, but maintain the spine and neck is a neutral position.

Make sure the stretch cord is under slight tension when the arms are outstretched. If the stretch cords are loose, move further away from the unit or use shorter cords.

Lock the elbows into a fixed joint position. This is maintained through the complete movement.

Pull the hands down and back, to a point that is even with or slightly behind the midline of the body. Squeeze the shoulder blades together as you pull back.

Slowly allow the arms to return to the starting position of the exercise.

Shoulder Joint Horizontal Abduction

Instructions:

The exercise is performed according to the following:

Position the body posterior to (behind) the anchor point.

Make sure the spine and neck are in a neutral position.

Position feet in order to be able to maintain balanced through the full movement pattern. The closer the feet are together, the more you balance is challenged.

Make sure the stretch cord is under slight tension at the starting position.

Lock the elbow joint in position. It should not change position (joint angles) during the exercise.

Pull the arm outward, across the body, keeping the hands in the horizontal line during the full movement. Stop the movement when the hand is not quite straight to your side. Keep you shoulders "down" during the exercise movement—do not pull it up to your ear.

Preacher Curl

Instructions:

Attach an stretch cord to the Apparatus and a handle.

Position yourself so that your arm is full supported by the stability ball (or whatever is used) that your elbow is anterior (forward) of the body.

Triceps Extension

Instructions:

The Triceps Extension exercise can be performed from many different body positions, but the following must happen to effectively train the Triceps muscles group.

Make sure the spine and neck are in a neutral position.

Make sure the stretch cord is under slight tension at the starting position.

Lock the upper arm into position. The upper arm should not change position (no movement in the shoulder joint) during the exercise.

Slowly (unless performing power movements) extend (straighten) the elbow joint until just before it is straight.

Slowly return the lower arm to the starting position of the exercise.

Triceps Dip

Instructions:

Place the hands on the Cross Bar with fingers forward, while sitting on the Cross Bar, Place the feet in the desired location for exercise performance.

Move the hips forward and off the Cross Bar, keep arms slightly bent at the elbow.

Slowly and controlled, bend the elbow until the upper arm is approximately parallel to the floor or to whatever shoulder joint position is comfortable (you don't feel as if you are over stretching the front of the shoulder)/

Press the arms down through the Cross bar in order to straighten the elbows and bring the body back to the start position of the exercise.

While there have been shown and described and pointed out the fundamental novel features of the invention as applied to the preferred embodiments, it will be understood that various omissions and substitutions and changes of the form and details of the apparatus illustrated and in the operation may be done by those skilled in the art, without departing from the spirit of the invention.

What is claimed is:

1. A self-contained portable exercise apparatus for performing upper and lower body exercises, comprising:

a ground-engaging base plate;

a first vertical tower rigidly attached to said base plate;

a first plurality of holes in said first vertical tower;

a second vertical tower rigidly attached to said base plate;

a second plurality of holes in said second vertical tower that are aligned with the first plurality of holes located in the first vertical tower;

said base plate extending between the first and second vertical towers, and said first and second plurality of holes being aligned toward each other in a same linear direction;

a first plurality of arc-shaped rods connected to the base plate for attaching stretch cords;

a cross bar that slidably extends through two aligned holes of the first and second plurality of holes in said first and second vertical towers;

a support bar having first and second vertical members that slidably couple to tops of the first and second vertical towers by inserting into the tops of the first and second vertical towers;

first and second collars on the first and second vertical members of the support bar to provide a stop to limit depth when the first and second vertical members are inserted into the tops of the first and second vertical towers;

a second plurality of arc-shaped rods connected to the first and second vertical towers for attaching stretch cords; and a third plurality of arc-shaped rods connected to the support bar for attaching stretch cords.

2. A self-contained portable exercise apparatus for performing upper and lower body exercises, comprising:

a ground-engaging base plate;

a first vertical tower rigidly attached to said base plate;

a first plurality of holes in said first vertical tower;

a second vertical tower rigidly attached to said base plate;

a second plurality of holes in said second vertical tower that are aligned with the first plurality of holes located in the first vertical tower;

said base plate extending between the first and second vertical towers, and said first and second plurality of holes being aligned toward each other in a same linear direction;

a first plurality of arc-shaped rods connected to the base plate for attaching stretch cords;

a cross bar that slidably extends through two aligned holes of the first and second plurality of holes in said first and second vertical towers;

a support bar having first and second vertical members that slidably couple to tops of the first and second vertical towers, wherein the first and second vertical members slide inside the tops of the first and second vertical towers;

a second plurality of arc-shaped rods connected to the first and second vertical towers for attaching stretch cords; and a third plurality of arc-shaped rods connected to the support bar for attaching stretch cords.

* * * * *